United States Patent [19]

Hall

[11] 4,241,626

[45] Dec. 30, 1980

[54] OPENER DEVICE FOR SEALED CANS

[76] Inventor: Frederick M. Hall, P.O. Box 494, Pasadena, Md. 21122

[21] Appl. No.: 1,010

[22] Filed: Jan. 4, 1979

[51] Int. Cl.[3] ..... B67B 7/00

[52] U.S. Cl. ..... 81/3.46 R

[58] Field of Search ..... 81/3.46 R, 3.46 A; 254/129, 130

[56] References Cited

U.S. PATENT DOCUMENTS

| | | | |
|---|---|---|---|
| 1,570,342 | 1/1926 | Dresser | 254/130 |
| 3,656,375 | 4/1972 | Reed et al. | 81/3.46 R |

*Primary Examiner*—James G. Smith

*Attorney, Agent, or Firm*—Walter G. Finch

[57] ABSTRACT

The invention is an improved opener device for opening sealed cans of the type using a pull-tab to initiate the opening. The device consists of rod-like tool having a handle on one end and a series of notches on the opposite end. One of the notches near the end hooks into the pull-tab and the other notches are on the opposite side and serve as a holding means on the rim of the can be opened and concurrently as a fulcrum point for the lever action to lift the pull-tab and thereby opening the can.

7 Claims, 2 Drawing Figures

OPENER DEVICE FOR SEALED CANS

BACKGROUND AND SUMMARY OF THE INVENTION

The invention relates to openers for sealed cans and in particular to cans having a pull-tab arrangement for making an opening in the can. Specifically, the invention provides a tool for hooking into such pull-tab arrangements so as to provide a lever action to gain mechanical advantage to break the seal and remove the pull-tab closure.

Many sealed cans are now being made with pull-tab type closures. These include beverages, nuts, and many other edibles and non-edible items.

The problem is that the pull-tab opener is not readily easy for all persons. Some older persons and some younger persons have difficulty in pulling on the tab to tear away the metal tab from the surrounding metal of the closure top or piece.

In some cases the pull-tab opens only a small aperture for pouring a liquid out of the container, and in other instances substantially the entire top of the closure is pulled out so that the contents of the container can be dumped out or spooned out in bits.

There is also the problem of possible cut fingers when a pull-tab closure does not open easily and the person grabs the partially opened tab or top to get a better grip. The fingers against the raw torn or cut edge where the tab or top pulls away is sharp and cut fingers are the result.

The present invention eliminates these problems by providing a tool device that gives a mechanical advantage through the lever-type action as the tool device is used. The device, which has a long rod-like configuration, has a top notch at one end for hooking into the tab and a series of notches on the opposite side of the rod-like portion 180° from the side where the top or end notch is located.

The series of notches provide points that fit the edge of various diameter containers and the notch acts as a fulcrum point when the rod-like device is pressed downward at the handle-end to lift the tab upward.

Thus older persons and younger persons gain the help of the lever arm mechanical advantage, and concurrently avoid the sharp edges of the tab and/or top and the edges of the closure where the opening is made.

It is, therefore, an object of the invention to provide an opener for opening sealed cans having pull-tab arrangements for opening.

It is another object of the invention to provide an opener that gives a mechanical advantage to the user.

It is still another object of the invention to provide an opener that protects the user from the sharp edges of the opened can and the pull-tab closure.

It is yet another object of the invention to provide an opener that is usable on a range of can diameters.

It is also an object of the invention to provide an opener that is useful for both older and younger persons who may have difficulty in removing the pull-tab type closures on cans.

Further objects and advantages of the invention will become more apparent in the light of the following description of the preferred embodiments.

DESCRIPTION OF THE PREFERRED EMBODIMENT

Figure 1:
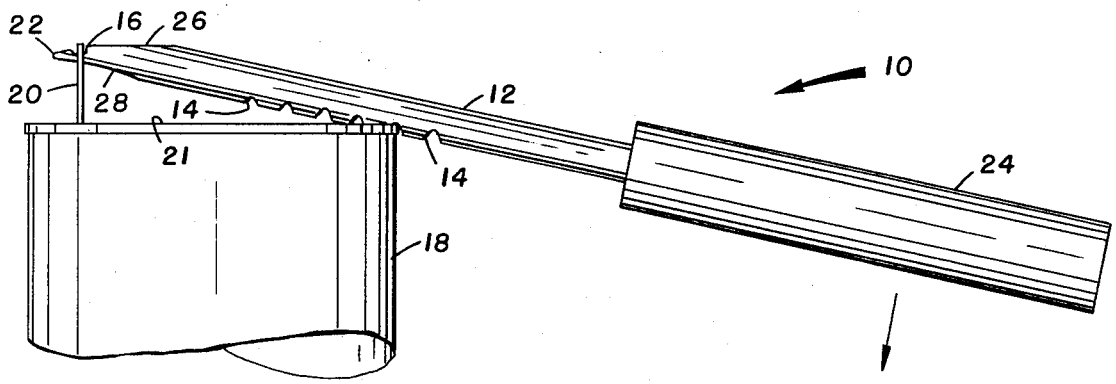
FIG. 1 is a side view of the opener device in place on a pull-tab type container ready for opening.

Referring to the drawings, an improved opener for pull-tab type closures is shown at 10.

The opener 10 consists of a rod-like shaft 12 and a handle 24. It is to be noted that the shaft 12 is rod-like and may be round in cross section as shown, but may be square, hexagonal or any other geometric configuration. Such variation in the cross section is within the scope and intent of this invention.

The shaft 12 has a flattened end 26 running out to the tip 22. The flattened end 26 is the top side. The bottom side 28 of the end is also partially flattened. It is to be understood that the flattened end 26 and 28 is for general convenience in passing it through the hole in the pull-tab 20, it is to be further understood that the end may be configured in a shape other than flat. The end 26 may be round, oval, or any other configuration and such variation is within the scope and intent of this invention.

The tip 22 may be straight across the shaft 12 or it may be slightly rounded or rounded to be semi-circular, or any other configuration.

The end of the shaft 12, opposide the flattened end 26, is fitted with a handle 24 for ease in gripping the device and operating it as a lever as hereinafter described.

The handle may be cylindrical, tapered, bulbous, or any other configuration to fit the hand comfortably. Variations in the shape are within the scope and intent of the invention.

The shaft 12 of the device may be metal or any other suitable material which will withstand the stress of lever action against the shaft. The handle 24 may be wood, metal, plastics, rubber-like material, or any other suitable material and may be separate from or monolithic and integral with said shaft. This wide range of materials for the handle and the shaft is within the scope and intent of the invention.

Figure 2:
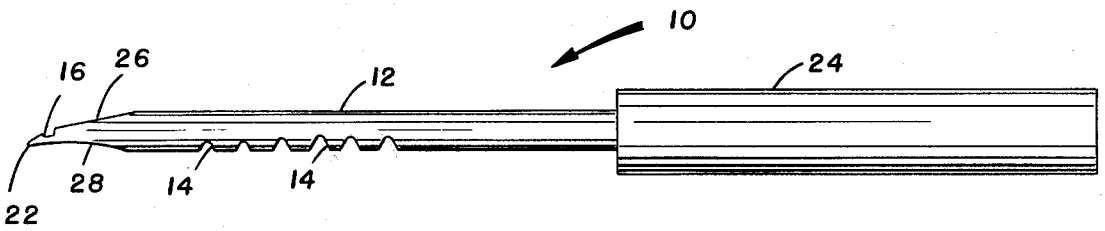
FIG. 2 is a side elevation of the opener device.

A top or end notch or groove 16, in both FIGS. 1 and 2, is used to engage the device 10 in the loop or hole in the pull-tab 20 and to prevent the pull-tab from slipping from the end of the device 10.

The series of notches or grooves 14 in the bottom, or opposite side from that in which the end notch or groove is cut, are used to position the shaft on the edge of a pull-tab type can to be opened. The series of grooves 14 allow the device to be used on a range of sizes of pull-tab type containers, a range of diameters of containers.

When the handle 24 is pressed downward as indicated by the arrow beneath the handle 24 in FIG. 1, the opposite end at the groove 16 will rise. As the handle 24 is pressed downwardly, notch 14 engages the rim 21 of the can 18. As the groove 16 rises it pulls the tab 20 upwardly and this tears the closure portion out of the top of the can 18.

For those pull-tab type closures which do not have an opening in the pull tab 20, through which the shaft 12 can be inserted, the end of the shaft at the notch 16 may be split or notched in a "V" or "U" type end (not shown) which can straddle the pull-tab 20 at the bottom near the closure top of the can 18.

It is to be understood that the variation in the number or configuration of the notches or grooves 14 and 16 is within the scope and intent of this invention. Likewise, the formation of a hook on the end instead of the notch 16 serves the same purpose and is within the scope and intent of the invention.

Accordingly, modifications and variations to which the invention is susceptible may be practiced without departing from the scope and intent of the appended claims.

What is claimed is:

1. An opening device for pull-tab sealed containers, comprising:

a rod-like member, said rod-like member having a plurality of spaced grooved notches thereon, the first one of said plurality of spaced grooved notches being on one side of and near the end of said rod-like member to insert into said pull tab, and the balance of said plurality of spaced grooved notches being located on said rod-like member 180° around and spaced apart from first said grooved notch, said balance of said plurality of grooved notches being spaced apart from each other along said rod-like member to individually rest upon edge of said pull-tab container; and a handle means, said handle means being attached to said rod-like member on the end opposite to the end having said grooved notches.

2. The opening device recited in claim 1 and additionally, the end of said rod-like member having said plurality of grooved notches being split in a "V" shape.

3. The opening device recited in claim 1 and additionally, the end of said rod-like member having said plurality of grooved notches being split in a "U" shape.

4. The opening device recited in claim 1, wherein said handle means is monolithic and integral with said rod-like member.

5. The opening device recited in claim 1, wherein said handle means is wood.

6. The opening device recited in claim 1, wherein said handle means is plastics.

7. The opening device recited in claim 1, wherein said handle means is a rubber-like material.

* * * * *